US005314665A

United States Patent [19]

Iwasa

[11] Patent Number: 5,314,665

[45] Date of Patent: May 24, 1994

[54] CATALYTIC CONVERTER

[75] Inventor: Yoshio Iwasa, Nagareyama, Japan

[73] Assignee: Nissan Motor Co., Ltd., Tokyo, Japan

[21] Appl. No.: 622,313

[22] Filed: Dec. 6, 1990

Related U.S. Application Data

[63] Continuation of Ser. No. 492,379, Mar. 12, 1990, abandoned, which is a continuation of Ser. No. 223,962, Jul. 26, 1988, abandoned.

[30] Foreign Application Priority Data

Jul. 27, 1987 [JP] Japan ..... 62-114926

[51] Int. Cl.[5] ..... B01D 50/00

[52] U.S. Cl. ..... 422/180; 422/222

[58] Field of Search ..... 422/171, 176, 177, 180, 422/190, 191, 193, 211, 220, 221, 222

[56] References Cited

U.S. PATENT DOCUMENTS

| | | | |
|---|---|---|---|
| 3,754,870 | 8/1973 | Carnahan et al. | 422/171 |
| 3,770,389 | 10/1973 | Kitzner et al. | 422/174 |
| 4,186,172 | 1/1980 | Scholz | 422/180 |
| 4,282,186 | 8/1981 | Nonnenmann et al. | 422/180 |
| 4,785,781 | 1/1974 | Hervert et al. | 422/171 |

*Primary Examiner*—Jill A. Johnston
*Assistant Examiner*—Milton I. Cano
*Attorney, Agent, or Firm*—Pennie & Edmonds

[57] ABSTRACT

A catalytic converter for purifying exhaust gas from an internal combustion engine. The catalytic converter is comprised of a honeycomb monolithic catalytic element disposed in a casing. The catalytic element includes flat and corrugated metallic sheets which are formed into a cylinder by putting one upon another and spirally winding the metallic sheets. Catalyst is supported on the surface of the metallic sheets to define a plurality of axially extending gas passages through which exhaust gas flows to be purified. A metallic surface of the metallic honeycomb carrier is exposed at the outer peripheral surface of the catalytic element. The exposed metallic surface or outer peripheral surface of the catalytic element is in direct contact with the inner peripheral surface of the casing, thereby preventing the catalyst from peeling off even upon gliding contact of the catalytic element with the casing while promoting heat transmission from the catalytic element to the casing.

8 Claims, 5 Drawing Sheets

CATALYTIC CONVERTER

This is a continuation of application Ser. No. 07/492,379 filed Mar. 12, 1990, and now abandoned, which is a continuation of application Ser. No. 07/223,962, filed Jul. 26, 1988, and now abandoned.

BACKGROUND OF THE INVENTION

1. Field of the Invention

This invention relates to a catalytic converter for purifying exhaust gas discharged from an internal combustion engine for an automotive vehicle, and more particularly to improvements in the catalytic converter having a honeycomb monolithic catalytic element whose catalyst carrier is formed of metallic sheets.

2. Description of the Prior Art

A variety of catalytic converters for purifying exhaust gas from automotive engines have been proposed and put into practical use. One of them is disclosed in Japanese Patent Provisional Publication No. 54-13462 and will be discussed with reference to FIGS. 7A and 7B. A catalytic converter shown in FIGS. 7A and 7B includes a casing 54 disposed in an exhaust pipe of an engine and houses therein a honeycomb monolithic catalyst 51 whose carrier is formed of metallic sheets. The carrier is formed by spirally winding a flat metallic sheet 52 and a corrugated Metallic sheet 53 upon putting one upon another. The thus formed carrier of the honeycomb type carries or supports catalyst on the surface of the metallic sheets 52, 53, thereby forming a plurality of gas passages 51*a*. The honeycomb monolithic catalyst 51 is tightly disposed in the casing 54 in such a manner that the outer peripheral surface of the catalyst 51 is in contact with the Inner peripheral surface of the casing 54. Exhaust gas from the engine is introduced into the honeycomb monolithic catalyst 51 to pass through the gas passages 51*a*, so that hydrocarbon, carbon monoxide and the like are oxidized to purify exhaust gas from the engine.

However, difficulties have been encountered in the thus configurated catalytic converter in which the outer peripheral surface 51*b* of the honeycomb monolithic catalyst 51 is in sliding contact with the inner peripheral surface 54*c* of the casing 54 during assembly of the catalytic converter and under vibration due to vehicle operation, so that catalyst on the outer peripheral surface of the catalyst is peeled off and scattered to ambient air. Additionally, transmission of reaction heat generated in the catalyst 51 to the casing 54 is suppressed under existence of the layer of the catalyst in contact with the inner peripheral surface of the casing. Accordingly, the honeycomb monolithic catalyst tends to rise in temperature, thereby deteriorating the durability of the catalyst.

SUMMARY OF THE INVENTION

It is an object of the present invention to provide an improved catalytic converter which prevents catalyst from scattering to ambient air while improving durability thereof.

The catalytic converter according to the present invention is comprised of a honeycomb monolithic catalytic element disposed in a casing. The catalytic element includes a metallic honeycomb carrier including flat and corrugated metallic sheets which are put one upon another and spirally wound to form therebetween elongate openings. Catalyst is supported on the surface of the metallic sheets defining the elongate openings. The metallic sheets with said catalyst defining gas passages through which exhaust gas from an internal combustion engine passes. Each gas passage is formed in each elongate opening. A metallic surface of the metallic honeycomb carrier is exposed at the outer peripheral surface of the honeycomb monolithic catalytic element. The exposed metallic surface of the honeycomb monolithic catalytic element is in direct contact with the inner peripheral surface of the casing.

Thus, the honeycomb monolithic catalytic element is housed in the casing in such a manner that the outer peripheral surface supporting no catalyst is in direct contact with the inner peripheral surface of the casing. Accordingly, the catalyst in the catalytic element is prevented from being peeled off even during assembly of the catalytic converter and even under vibration of vehicle operation, thereby preventing the catalyst from scattering in powder form to ambient air. Additionally, since the layer of the catalyst does not exist between the outer peripheral surface of the cylindrical honeycomb catalytic element and the inner peripheral surface of the casing, transmission of reaction heat generated in the catalytic element to the casing can be promoted thereby improving the durability of the honeycomb monolithic catalytic element. This also reduces the amount of catalyst to be used in each catalytic converter thereby lowering production cost of catalytic converters.

BRIEF DESCRIPTION OF THE DRAWINGS

In the drawings, like reference numerals designate like elements and parts throughout all the figures, in which.

DETAILED DESCRIPTION OF THE INVENTION

Figure 1A:
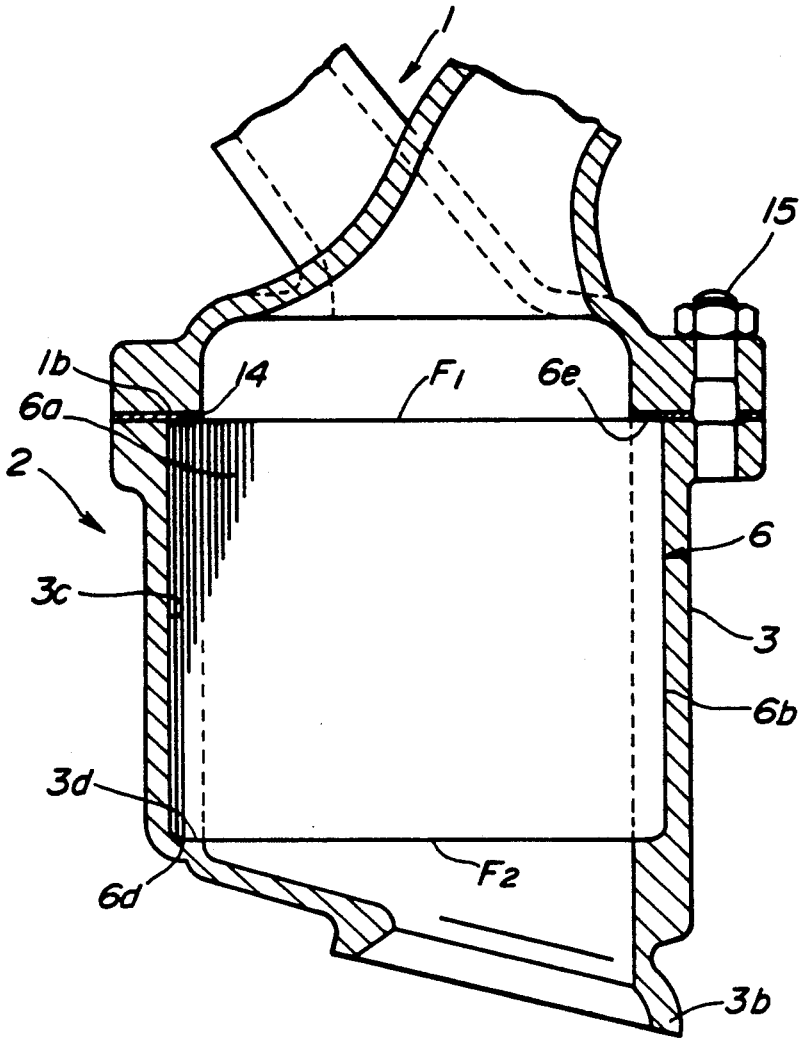
FIG. 1A is a vertical sectional view of a first embodiment of a catalytic converter in accordance with the present invention.
Figure 1B:
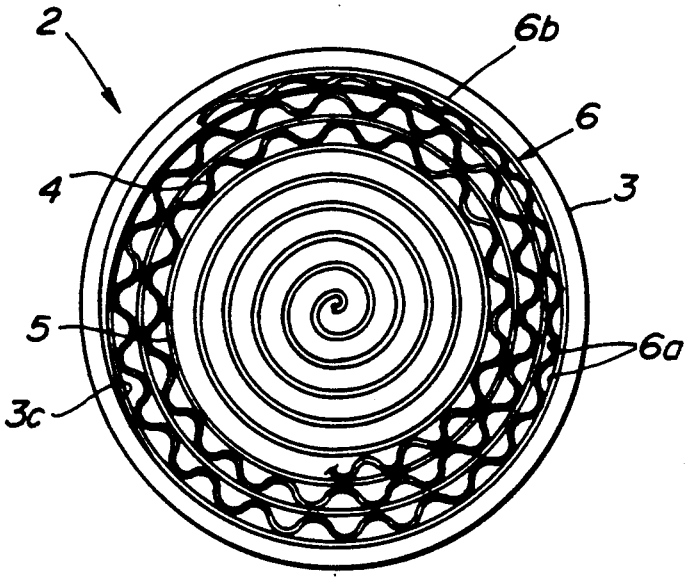
FIG. 1B is a transverse sectional view of the catalytic converter of FIG. 1.

Referring now to FIGS. 1A and 1B of the drawings, there is shown a first embodiment of a catalytic converter 2 in accordance with the present invention. The catalytic converter 2 is connected to an exhaust manifold 1 of an internal combustion engine (not shown) of an automotive vehicle. High temperature exhaust gas from a plurality of engine cylinders are gathered into the exhaust manifold 1 and introduced into the catalystic converter 2 to purify exhaust gas. The catalytic converter 2 functions to oxidize and/or reduce noxious components of the exhaust gas to convert them into harmless gases.

Figure 2:
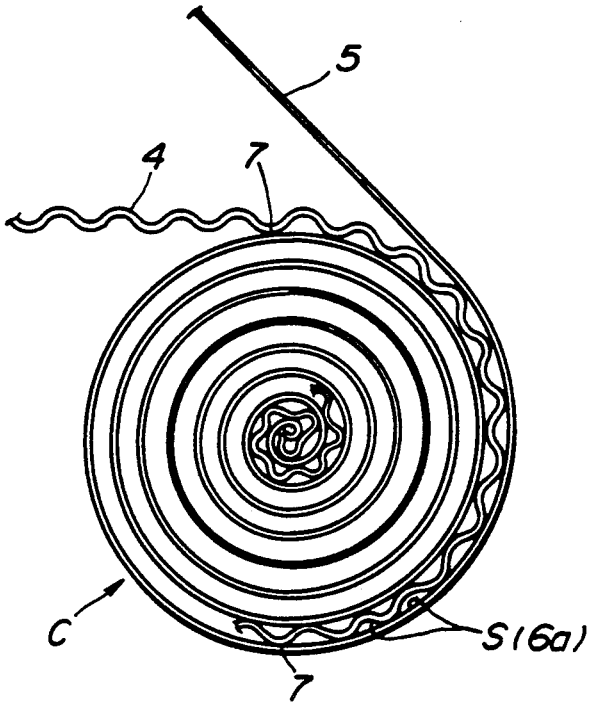
FIG. 2 is an axial view of a catalytic element of the catalytic converter of FIG. 1, showing a manner of producing the catalytic element.

The catalytic converter 2 includes a generally cylindrical honeycomb monolithic catalytic element 6 disposed within a generally cylindrical metallic casing 3. The catalytic element 6 includes a generally cylindrical honeycomb carrier C constructed of a flat metallic sheet or foil 5 and a corrugated metallic sheet or foil 4 as shown in FIG. 2. Each of the metallic sheets 5, 4 is made of ferrite stainless steel. In this embodiment, the flat metallic sheet 5 and the corrugated metallic sheet 4 are put one upon another and spirally wound as shown in FIG. 2, so that a plurality of axially extending openings S (in FIG. 2) are formed between the adjacent metallic sheets 5, 4. The metallic sheets 6, 4 are fixed with each other by means of beam or spot welding, thereby forming welding sections or points 7 as shown in FIG. 2. This welding sections 7 are formed at intervals of an angle of 180 degrees in the peripheral direction or in the winding angle of the metallic sheets 5, 4. Additionally, three to five welding sections 7 are formed in the axial direction of the metallic honeycomb carrier C. Such welding manner enables metallic honeycomb carrier C to elastically deform to some extent, thereby allowing the elastic deformation of the catalytic element 6 to some extent corresponding to the inner wall surface 3c of the casing 3.

Figure 5:
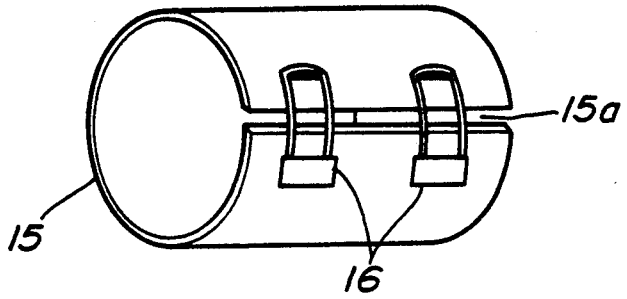
FIG. 5 is a perspective view of a masking band to be used in preparing a catalytic element in the catalytic converter of FIGS. 4A and 4B.

A predetermined amount of catalyst (not identified) is carried or supported on the surface of the metallic sheets 4, 5 defining the axially extending openings S. It is to be noted the catalyst is not carried or supported on the outer peripheral surface of the cylindrical metallic honeycomb carrier C, so that a metallic surface is exposed at the outer peripheral surface of the cylindrical metallic honeycomb carrier C. Exposing the metallic surface without carrying catalyst is accomplished by coating the metallic honeycomb carrier C upon covering the outer peripheral surface of the metallic honeycomb carrier C with a masking band 15 as shown in FIG. 5 after the metallic sheets 4, 5 are fixed to each other as shown in FIG. 2. Thus, a honeycomb monolithic catalytic element 6 is prepared. The catalytic element 6 is formed therein a plurality of gas passages 6a each of which is defined by the surfaces of metallic sheets 4, 5 carrying the catalyst. Therefore, each gas passage 6a axially extends and therefore generally corresponds to each axially extending opening S. Each gas passage 6a extends from an inlet face $F_1$ to an outlet face $F_2$ of the catalytic element 6 as shown in FIG. 1A. It will be understood that exhaust gas from the engine is introduced through the inlet face $F_1$ into the gas passages 6a and discharged through the outlet face $F_2$ from the gas passages 6a. The thus prepared catalytic element 6 is press-fitted within the casing 3 in such a manner that the exposed cylindrical outer peripheral surface 6d carrying no catalyst is brought into tight contact with the cylindrical inner peripheral surface 3c of the casing 3 as shown in FIGS. 1A and 1B, so that metal-to-metal contact is established between the catalytic element 6 and the casing 3. The outer peripheral section 6e of the to inlet face $F_1$ of the catalytic element 6 contacts through a gasket 14 with the contacting surface 1b of an annular projection (no numeral) of the exhaust manifold 1, while the outer peripheral section 6d of the outlet face $F_2$ of the catalytic element 6 contacts with the annular seat section or step section 3d of the casing 3, so that the honeycomb monilithic catalytic element 6 is tightly maintained in position. The casing 3 is rigidly connected to the exhaust manifold 1 by means of bolts 15. The open end section 3b of the casing 3 will be connected to an exhaust pipe (not shown).

The operation of the thus configurated catalytic converter 2 will be discussed hereinafter.

Since the outer peripheral surface 6d forms the metal-exposed surface carrying no catalyst, catalyst is prevented from being removed from the outer peripheral surface 6d of the catalytic element 6 even upon sliding contact with the inner peripheral surface 3c of the casing 3 during assembly of the catalytic converter 2 in which the catalytic element 6 is press-fitted into the casing 3, thereby preventing the catalyst from scattering in powder form into the atmosphere. Additionally, catalyst is prevented from scattering in powder form into atmosphere even if the honeycomb monolithic catalytic element 6 slidingly contacts with the inner surface 3c of the casing 3 upon vibrational displacement of the catalytic element 6 relative to the casing 3 in the rotational and axial directions under engine vibration and impact transmitted from the vehicle body during vehicle cruising.

Reaction heat generated in the catalytic element 6 is transmitted through the metallic sheets 4, 5 from the catalytic element 6 to the casing 3 and released from the casing 3 to ambient air. In this process, heat transmission of the catalytic element 6 to the casing 3 can be promoted because of the fact that metal-to-metal contact is established between the outer peripheral surface 6b of the catalytic element 6 and the inner peripheral surface 3c of the casing 3 without catalyst carried on the outer peripheral surface of the catalytic element 6, thereby preventing thermal deterioration of the catalyst in the catalytic element 6 and production of cracks at the welding sections 7 between the metallic sheets 4. 5.

Figure 3:
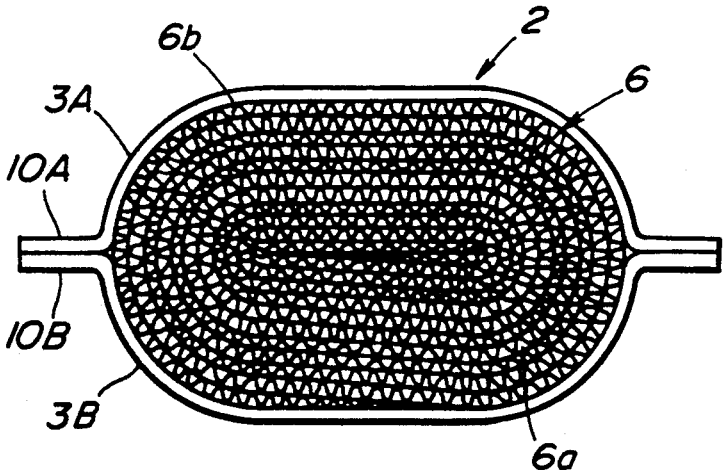
FIG. 3 is a transverse sectional view of a second embodiment of the catalytic converter in accordance with the present invention.

FIG. 3 illustrates a second embodiment of the catalytic converter 2 in accordance with the present invention, similar to the first embodiment with the exception that the honeycomb monolithic catalytic element 6 is of the shape of an elliptic cylinder. In this embodiment, the casing 3 includes two generally semicylinderical counterparts 3A, 3B having respective flange sections 10A, 10B which are fastened with each other by means of bolts (not shown). By tightening the bolts, a predetermined pressure is applied though the casing counterparts 3A, 3B to the outer peripheral surface 64 of the honeycomb monolithic element 6, thereby omitting the play of the catalytic element 6 relative to the casing 3 and promoting heat transmission from the catalytic element 6 to the casing 3. Also in this case, no catalyst is carried or supported on the outer peripheral surface 6b of the catalytic element 6 to expose a metallic surface.

Figure 4A:
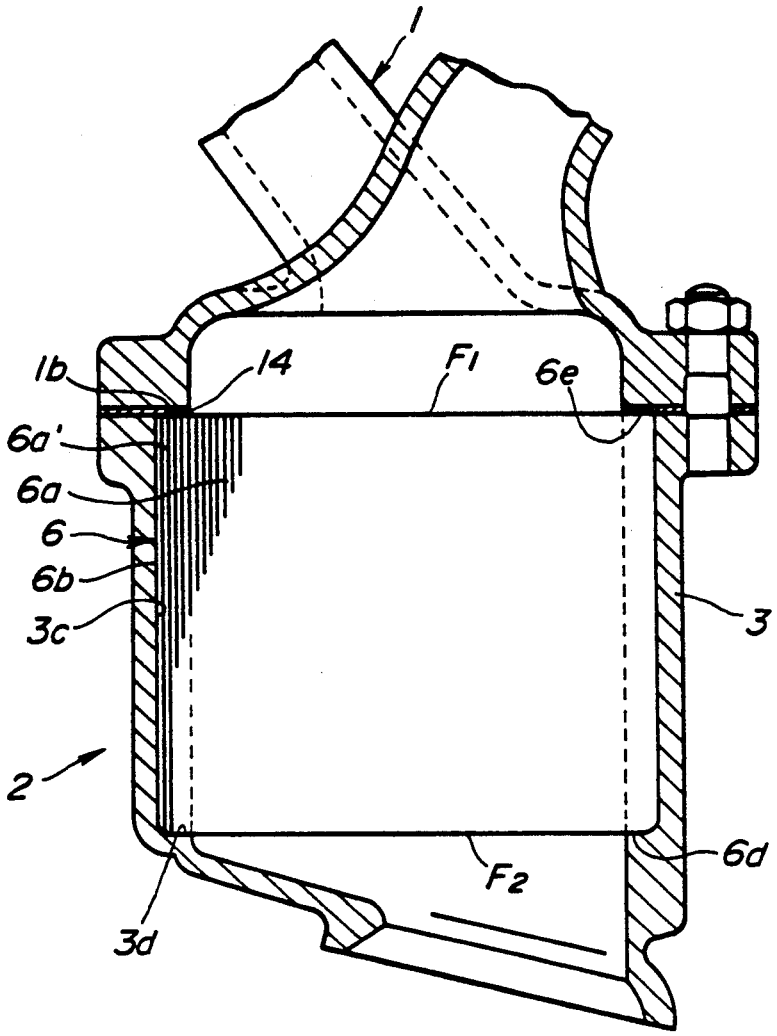
FIG. 4A is a vertical sectional view of a third embodiment of the catalytic converter in accordance with the present invention.
Figure 4B:
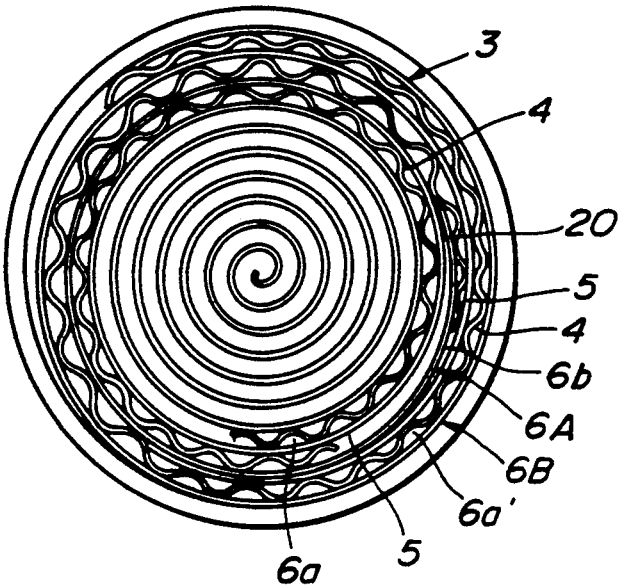
FIG. 4B is a transverse sectional view of the catalytic converter of FIG. 4A.

FIGS. 4A and 4B illustrate a third embodiment of the catalytic converter 2 in accordance with the present Invention which is similar to the first embodiment with the exception that the honeycomb monolithic catalytic element 6 includes a generally is cylindrical inner element 6A and a generally annular outer element 6B. The outer element 6B is located around the inner element 6A. In this embodiment, the inner element 6A carries or supports a predetermined amount of the catalyst, while the outer element 6B carries or supports no catalyst. The outer element 6B may carry or support a small amount of catalyst except for the outer peripheral surface in contact with the casing.

The inner element 6A includes a metallic honeycomb carrier constructed of the flat and corrugated metallic sheets 5, 4 which are put one upon another and spirally wound like in FIG. 2. The flat and corrugated metallic sheets 5, 4 are fixed with each other by carrying out beam or spot welding so as to form the welding sections (7) at intervals of an angle of 180 degrees in the peripheral direction or in the winding angle of the metallic sheets 5, 4. Additionally, three to five welding sections 7 are formed in the axial direction of the metallic honeycomb carrier. The outer or terminal end section 20 of the flat metallic sheet 5 is fixed to the precedent section of the same metallic sheet 5 by the beam welding.

No catalyst is carried or supported on the outer peripheral surface of the metallic honeycomb carrier of the inner element 6A, thereby exposing a metallic surface on the outer peripheral surface of the inner element 6A. Such an exposed metallic surface is obtained by convering the outer peripheral surface of the cylindrical metallic honeycomb carrier of the inner element 6A with the cylindrical masking band 15 in FIG. 5 during coating operation of the honeycomb carrier with the catalyst. The masking band 15 is formed with an axially extending slit 15*a*. The slit 15*a* is narrowed by fastening clamps 16 after the masking band 15 is fitted around the outer peripheral surface of the honeycomb carrier of the inner element 6A, so that the outer peripheral surface of the honeycomb carrier is tightly covered with the masking band 15.

The annular honeycomb carrier of the outer element 6B is formed by sprirally winding the flat and corrugated metallic sheets 5. 4 upon putting one upon another. The flat and corrugated sheets are fixed to each other by beam welding thereby to form welding sections 7 at intervals of an angle of 180 degrees in the peripheral direction of in the winding angle of the metallic sheets 5, 4. Additionally, three to five welding sections 7*a* are formed in the axial direction of the metallic honeycomb carrier. In this embodiment, formation of the annular honeycomb carrier of the outer element 6B is accomplished as follows: First the initial end sections of the flat and corrugated metallic sheets 5, 4 of the outer element 6B are fixed to the terminal end section of the flat metallic sheet 5 of the inner catalytic element 6A by means of beam or spot welding. Then, the flat and corrugated metallic sheets 5, 4 are spirally wound around the inner element 6A as described above. The flat and corrugated metallic sheets 5, 4 are made of ferrite stainless steel.

The thus formed catalytic element 6 is tightly disposed within the casing 3 in such a manner that the outer peripheral section 6*e* of the inlet face $F_1$ of the catalytic element 6 contacts through the gasket 14 with the contacting surface 1*b* of the exhaust manifold 1 while the outer peripheral section 6*d* of the downstream face $F_2$ of the catalytic element 6 contacts with the annular seat section or step section 3*d* of the casing 3. In this connection, the outer peripheral sections 6*e*, 6*d* of the upstream and downstream faces $F_1$, $F_2$ of the catalytic element 6 correspond to the outer element 6B. Accordingly, the axially extending openings 6*a*' in the outer element 6B is closed with the exhaust manifold contacting surface 1*b* and the casing step section 3*d*, and therefore the openings 6*a*' are independently confined so that exhaust gas cannot pass through the openings 6*a*'. Thus, the exhaust contacting surface 1*b* and the casing step section 3*d* are formed to have predetermined inner diameters corresponding to the inner diameter of the outer element 6B.

Also with the thus configurated catalytic converter 2, the outer peripheral surface 6*b* of the outer catalytic element 6 forms a surface carrying no catalyst thereby preventing catalyst from scattering to ambient air during assembly of the catalytic converter and operation of the vehicle.

Exhaust gas from the engine is purified passing through the gas passages 6*a* of the inner element 6A to generate reaction heat. The reaction heat is transmitted through the outer element 6B to the casing 3, and therefore the abrupt temperature change of the metallic honeybcomb catalytic element can be suppressed thereby preventing crack from production in each welding suction (7). By thus stabilizing the thermal condition of the metallic honeycomb catalytic element 6, it is possible to use the inner element 6A at temperatures higher than in the first embodiment, thereby improving purifying ability of the catalyst element 6 and reducing the amount of catalyst to be carried, leading to cost reduction.

Figure 6A:
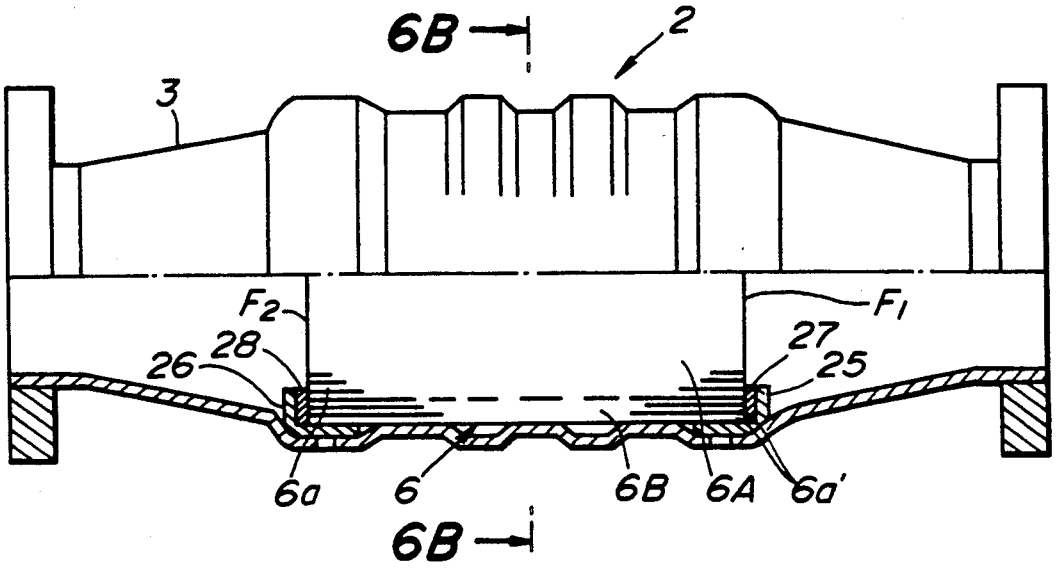
FIG. 6A is a front elevation, partly in section, of a fourth embodiment of the catalytic converter in accordance with the present invention.
Figure 6B:
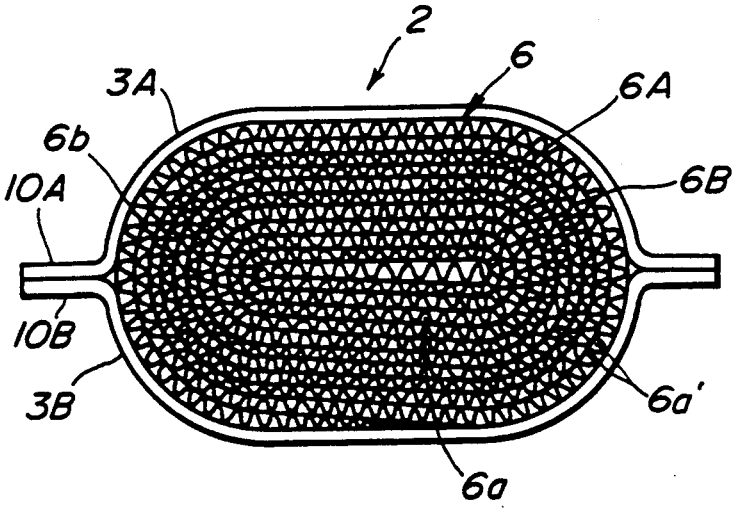
FIG. 6B is a transverse sectional view taken in the direction of arrows substantially along the line 6B—6B of FIG. 6A.
Figure 7A:
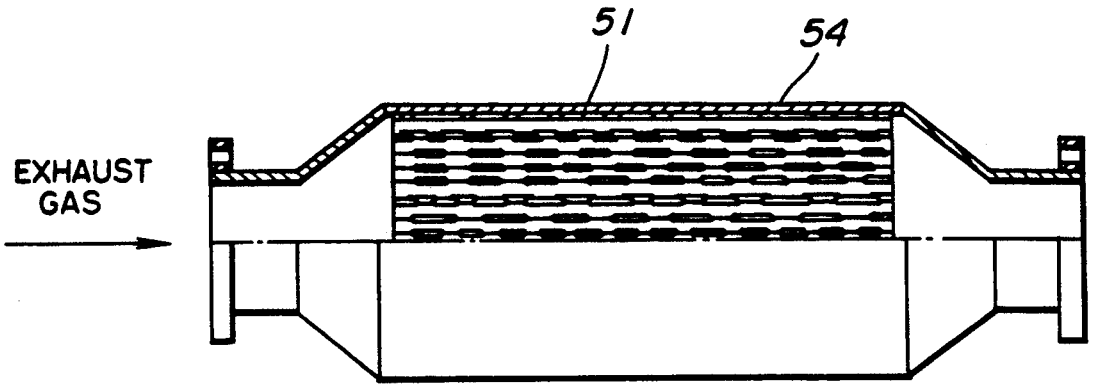
FIG. 7A (PRIOR ART)
FIG. 7A is a front elevation, partly in section, of a conventional catalytic converter.
Figure 7B:
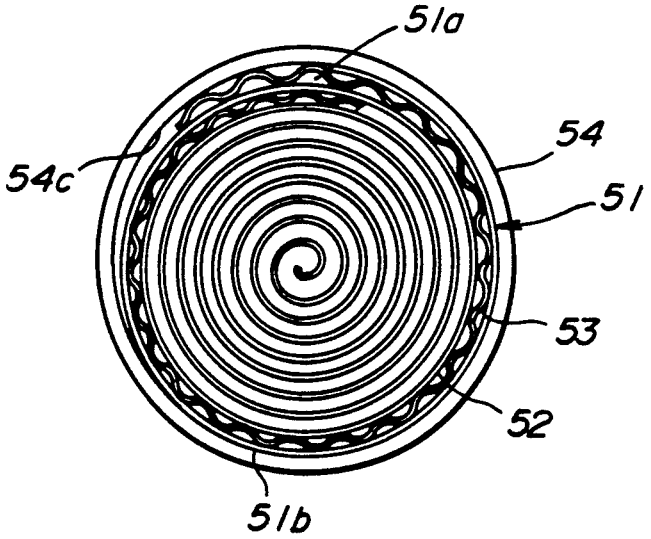
FIG. 7B (PRIOR ART)
FIG. 7B is a transverse sectional view of the catalytic converter of FIG. 7A.

FIGS. 6A and 6B illustrate a fourth embodiment of the catalytic converter 2 in accordance with the present invention, which is similar to the third embodiment of FIGS. 4A and 4B with the exception that the honeycomb monolithic catalytic element 6 is of the shape of an elliptic cylinder. In this embodiment, the casing 3 includes the two generally semicylindrical counterparts 3A, 3B having the respective flange sections 10A, 10B which are fastened with each other by means of bolts (not shown) like in the second embodiment of FIG. 3. Also in this embodiment, the honeycomb monolithic element 6 includes the inner element 6A carrying the catalyst, and the outer element 6B carryig no catalyst, like in the third embodiment. The inner and outer elements 6A, 6B are constructed and arranged like in the third embodiment. The casing 3 is provided at its inner peripheral surface 3*c* with two annular flanges 25, 26 each of which radially inwardly extends and is fixed to the inner peripheral surface 3*c* by means of welding. The two annular flanges 25, 26 are spaced from and opposite to each other so that the honeycomb monolithic catalytic element 6 is positioned therebetween. More specifically, the inlet face $F_1$ of the catalytic element 6 contacts through a gasket 27 with the annular flange 25, while the outlet face $F_2$ of the same contacts through a gasket 27 with the annular flange 26. Additionally, the openings 6*a*' are closed at their opposite ends with the annular flange 25 with the gasket 27 and the annular flange 26 with the gasket 28, so that exhaust gas cannot flow through the openings 6*a*' formed in the outer element 6B.

What is claimed is:

1. A catalytic converter for purifying exhaust gas from an internal combustion engine, comprising:

a casing;

a honeycomb monolithic catalytic element disposed in said casing and including a metallic honeycomb carrier including flat and corrugated metallic sheets which are put one upon another and spirally wound to form therebetween elongate openings, wherein the spirally wound carrier is formed such that said flat sheet forms an outer peripheral surface which contacts an inner peripheral surface of said casing, and catalyst supported on the surfaces of said flat and corrugated metallic sheets defining said elongate openings, said catalyst supported on the surfaces of said flat and corrugated metallic sheets defining gas passages through which exhaust gas from the engine passes, a gas passage being formed in each elongate opening;

wherein said outer peripheral surface which contacts said inner peripheral surface of said casing is an exposed metallic surface with no catalyst supported or disposed thereon such that said exposed metallic surface of said honeycomb monolithic catalytic element is in direct contact with said inner peripheral surface of said casing with no catalyst therebetween.

2. A catalytic converter according to claim 1, wherein said casting is made of metal.

3. A catalytic converter according to claim 1, further comprising means for preventing exhaust gas from flowing through an outer peripheral section of said catalytic element containing said exposed metallic surface.

4. A catalytic converter according to claim 1, wherein said honeycomb monolithic catalytic element forms a generally annular metallic honeycomb structure, an outer peripheral surface of said metallic honeycomb structure being exposed with no catalytic element and being in contact with said inner peripheral surface of said casing.

5. A catalytic converter according to claim 4, further comprising means for preventing exhaust gas from passing through some of said openings defined in said annular metallic honeycomb structure.

6. A catalytic converter according to claim 1, wherein said honeycomb monolithic catalyst element is cylindrically shaped having a circular cross section.

7. A catalytic converter according to claim 1, wherein said honeycomb monolithic catalyst element is cylindrically shaped having an elliptical cross section.

8. A catalytic converter for purifying exhaust gas from an internal combustion engine, comprising:

a casing;

a honeycomb monolithic catalytic element disposed in said casing and including a metallic honeycomb carrier including flat and corrugated metallic sheets which are put one upon another and spirally wound to form therebetween elongate openings, wherein the spirally wound carrier is formed such that said flat sheet forms an outer peripheral surface which contacts an inner peripheral surface of said casing, and catalyst supported on the surfaces of said flat and corrugated metallic sheets defining said elongate openings, said catalyst supported on the surfaces of said flat and corrugated metallic sheets defining gas passages through which exhaust gas from the engine passes, a gas passage being formed in each elongate opening; and means for improving heat flow from said honeycomb monolithic catalytic element to said casing, wherein said heat flow improving means is formed by said outer peripheral surface which contacts said inner peripheral surface, said outer peripheral surface being exposed metal with no catalyst so that said exposed metal surface is in direct contact with said inner peripheral surface with no catalyst therebetween.

* * * * *